US006116354A

United States Patent [19]

Buytaert

[11] Patent Number: 6,116,354

[45] Date of Patent: Sep. 12, 2000

[54] ROTARY STEERABLE SYSTEM FOR USE IN DRILLING DEVIATED WELLS

[75] Inventor: Jean Buytaert, Houston, Tex.

[73] Assignee: Weatherford/Lamb, Inc., Houston, Tex.

[21] Appl. No.: 09/274,458

[22] Filed: Mar. 19, 1999

[51] Int. Cl.[7] ..... E21B 7/04; E21B 7/08

[52] U.S. Cl. ..... 175/55; 175/45; 175/73

[58] Field of Search ..... 175/73, 74, 76, 175/40, 45, 51, 55, 61

[56] References Cited

U.S. PATENT DOCUMENTS

| | | | |
|---|---|---|---|
| 3,095,924 | 7/1963 | Frisby . | |
| 3,280,923 | 10/1966 | Muench . | |
| 4,241,796 | 12/1980 | Green et al. | 175/24 |
| 4,319,649 | 3/1982 | Jeter . | |
| 4,394,881 | 7/1983 | Shirley . | |
| 4,416,339 | 11/1983 | Baker et al. . | |
| 4,834,193 | 5/1989 | Leitko, Jr. et al. | 175/19 |
| 5,307,885 | 5/1994 | Kuwana et al. . | |
| 5,316,090 | 5/1994 | Kuwana et al. . | |
| 5,318,138 | 6/1994 | Dewey et al. | 175/74 |
| 5,394,951 | 3/1995 | Pringle et al. | 175/45 |
| 5,553,678 | 9/1996 | Barr et al. . | |
| 5,553,679 | 9/1996 | Thorp . | |
| 5,582,259 | 12/1996 | Barr . | |
| 5,582,260 | 12/1996 | Murer et al. . | |
| 5,673,763 | 10/1997 | Thorp . | |
| 5,685,379 | 11/1997 | Barr et al. . | |
| 5,695,015 | 12/1997 | Barr et al. . | |
| 5,706,905 | 1/1998 | Barr . | |
| 5,803,185 | 9/1998 | Barr et al. . | |

OTHER PUBLICATIONS

Barr et al., Steerable Rotary Drilling With an Experimental System, *SPE/IADC Drilling Conference*, 1995, p. 435–450.

Flatern, Steering clear of problem well paths, *Offshore Eng.*, Oct. 1998, p. 37–39.

Internet Search; Steerable rotary drilling systems and method of operating such systems; Barr.

*Primary Examiner*—Frank S. Tsay

*Attorney, Agent, or Firm*—Tobor, Goldstein & Healey; Clarence E. Eriksen

[57] ABSTRACT

A rotary steerable system for use in a drill string for drilling a deviated well is disclosed. The system utilizes a mechanical gravity reference device comprising an unbalanced weight which may rotate independently of the rotation of the drill string so that its heavy portion is always oriented toward the low side of the wellbore and which has an attached magnet. A magnetic switch that rotates as the drill string rotates is activated when its axis coincides with the axis of the magnet, and this activation results in a thrust member or pad being actuated to "kick" the side of the wellbore.

11 Claims, 3 Drawing Sheets

ROTARY STEERABLE SYSTEM FOR USE IN DRILLING DEVIATED WELLS

BACKGROUND OF THE INVENTION

1. Field of the Invention

The present invention relates to a rotary steerable system for use in drilling a deviated well.

2. Description of the Prior Art

When drilling a hole in a subsurface formation, it is often desirable to be able to vary and control the direction of drilling. This is particularly true in the case of drilling a deviated well, i.e., one whose borehole is not perpendicular to the earth.

Rotary drilling is defined as a method in which a bottom hole assembly, including the drill bit, is connected to the drill string which is rotatably driven from the drilling platform at the surface. Until recent years, fully controllable directional drilling has normally required the drill bit to be rotated by a downhole motor or a turbine. The drill bit may then, for example, be coupled to the motor by a bent unit whereby the central axis of the drill bit is inclined with respect to the axis of the motor. When variation of the direction of drilling is required, the rotation of the drill string is stopped, and the drill string oriented in the new direction. Continued rotation by the drill bit by the motor then causes the bit to drill in the new direction. Although such arrangements can, under favorable conditions, permit accurately controlled directional drilling to be achieved, rotary drilling is a preferred form of drilling. Rotary drilling allows one to drill a smoother trajectory of the well, and also reduces friction of the drill string on the low side of the hole, therefore allowing a better transmission of the weight from the surface down to the drill bit.

Accordingly, in recent years, attention has been given to the development of arrangements for achieving a rotary steerable system. Some of those systems are for connection in the bottom hole assembly of a drill string and have comprised a number of hydraulic actuators spaced apart around the periphery of the unit. Each of the actuators has a moveable thrust member or pad which is hydraulically displaceable outwardly for engagement with the formation of the borehole being drilled. The rotary steerable system also includes a selector apparatus which, when actuated, causes each of the moveable thrust members to be displaced outwardly at the same selective rotational position, which biases the drill bit laterally and thus controls the direction of drilling.

Prior art rotary steerable systems, in addition to being rather complex, have used the drilling fluid to actuate the moveable thrust members or pads. No prior art rotary steerable system to applicant's knowledge has contained a reference device which utilizes a simple mechanical device to provide a gravity reference.

SUMMARY OF THE INVENTION

In accordance with the present invention, a rotary steerable system for use in a rotating drill string for drilling a deviated well is provided. The system includes a housing which is connected between the drill bit and the top sub of a rotating drill string and which includes one or more pads that are on the periphery of the housing. Each pad imparts a force to the side of the borehole, when the pad is actuated.

A rotary steerable system in accordance with the present invention comprises a cartridge which is installed in the housing and which rotates with the drill string. The system of the present invention utilizes gravity as a reference, and a gravity reference device is contained in the cartridge, which device comprises an unbalanced weight. The unbalanced weight is able to move inside the cartridge independently of the rotation of the drill string, and the heavy portion of the unbalanced weight is thus always oriented toward the low side of the borehole. The unbalanced weight is preferably an unbalanced sleeve which is mounted on bearings in the cartridge. The gravity reference device also includes a magnet, which is mounted in a known relationship to the unbalanced weight. Preferably, the magnet is mounted on a face of the unbalanced sleeve so that the magnet is always oriented toward the top side of the borehole.

A rotary steerable system in accordance with the present invention also includes one or more magnetic switches which are contained in the cartridge, and which rotate with the drill string. The number of magnetic switches is equal to the number of pads, and the magnetic switch or switches are preferably contained in a carrier in the cartridge that can be rotated independent of the movement of the cartridge. The angular orientation of the magnetic switch with respect to the pad with which it is associated is known and when the axis of the magnetic switch coincides with the axis of the magnet, the magnetic switch is actuated. Circuitry is included in the housing which is operatively coupled to each magnetic switch and which responds to the actuation of the magnetic switch to trigger the actuation of the pad with which the switch is associated.

The rotary steerable system of the present invention further comprises apparatus which functions to change the angular position of each magnetic switch with respect to the pad with which it is associated. In one embodiment of the present invention, this apparatus comprises an electric motor which causes the carrier containing the magnetic switch or switches to rotate in the cartridge independent of the rotation of the drill string. The operation of the electric motor is preferably controlled by the pressure in the bottom hole assembly, the speed of rotation of the drill string, the flow rate of drilling fluid in the bore of the drill string or any combination of these conditions.

DESCRIPTION OF SPECIFIC EMBODIMENTS

It will be appreciated that the present invention can take many forms and embodiments. Some embodiments of the invention are described so as to give an understanding of the invention. The specific embodiments described herein are intended to illustrate, and not to limit, the present invention.

Figure 1:
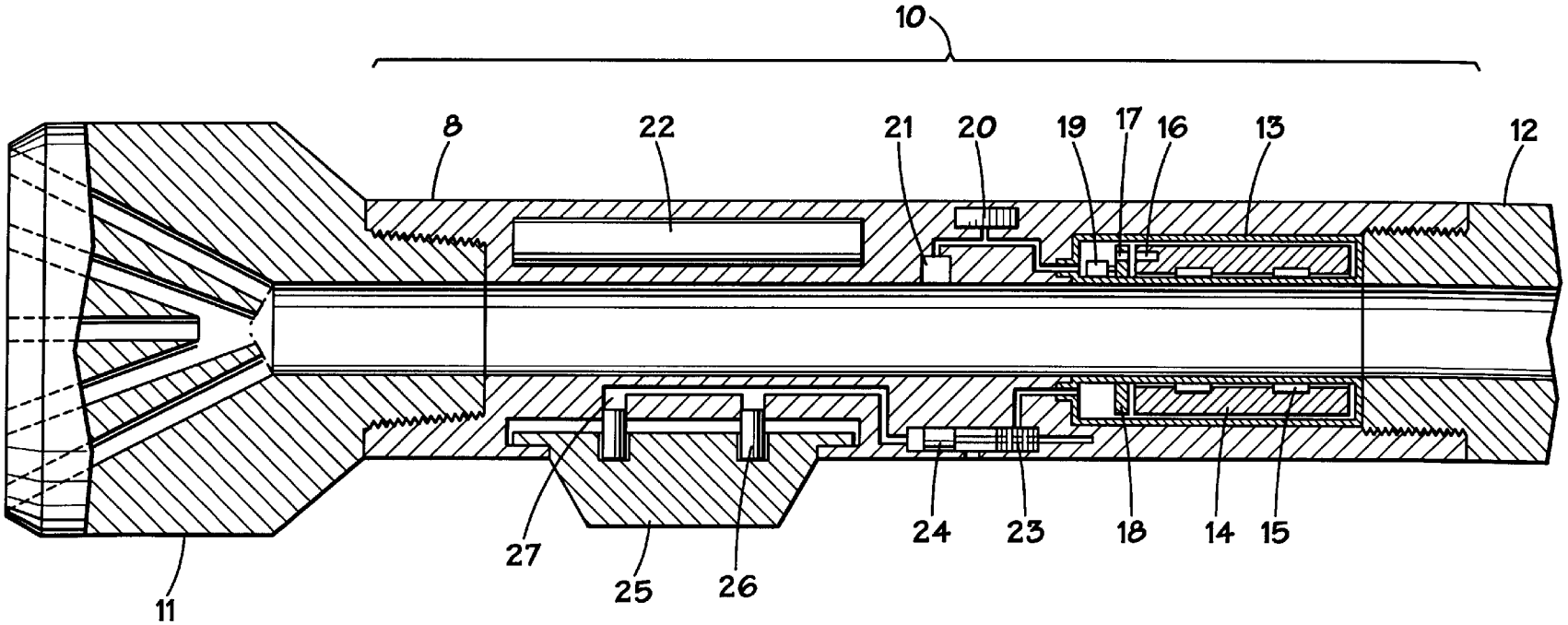
FIG. 1 is a cross-sectional view taken along the longitudinal axis of a drill string containing a rotary steerable system in accordance with the present invention.

With reference first to FIG. 1, rotating drill string 9 comprises drill bit 11 and top sub 12. Rotary steerable system 10 is connected in the drill string 9 between drill bit 11 and top sub 12 by threaded connections at its respective ends. Rotary steerable system 10 has a central bore which matches the central bores in drill bit 11 and top sub 12. Rotary steerable system 10 includes housing 8, and various types of material exist from which housing 8 may be fabricated. For example, various types of steel suitable for use in bottom hole assemblies may be used for housing 8.

Rotary steerable system 10 also includes a thrust member or pad 25 which is installed on the periphery of housing 8, as illustrated in FIG. 1. Two thrust pistons 26 are associated with pad 25, and when the thrust pistons are actuated (as described below), pad 25 is "kicked" against the wall of the borehole. A lateral force is thus created whose direction is 180° opposite to the movement of the pad, which tends to steer the drilling bit accordingly.

The interior of housing 8 is suitably machined to receive sleeve-like cartridge 13, and cartridge 13 contains a gravity reference device, which comprises unbalanced weight 14. The unbalanced weight 14 is suitably mounted within cartridge 13 such that it may move independent of the drill string. In other words, the heavy portion of unbalanced weight 14 is always oriented toward the low side of the well bore. Preferably, the unbalanced weight 14 comprises an unbalanced sleeve which is rotatably mounted on bearings 15 within cartridge 13. This unbalanced sleeve may be fabricated by making one portion from a light alloy steel and the other portion from a heavier alloy steel. The gravity reference device further comprises magnet 16 which is attached in the cartridge at a known location. Magnet 16 may be a permanent magnet or an electromagnet. Preferably, magnet 16 is attached to a face of the unbalanced sleeve so that it is always oriented opposite to the orientation of the unbalanced sleeve.

Figure 2:
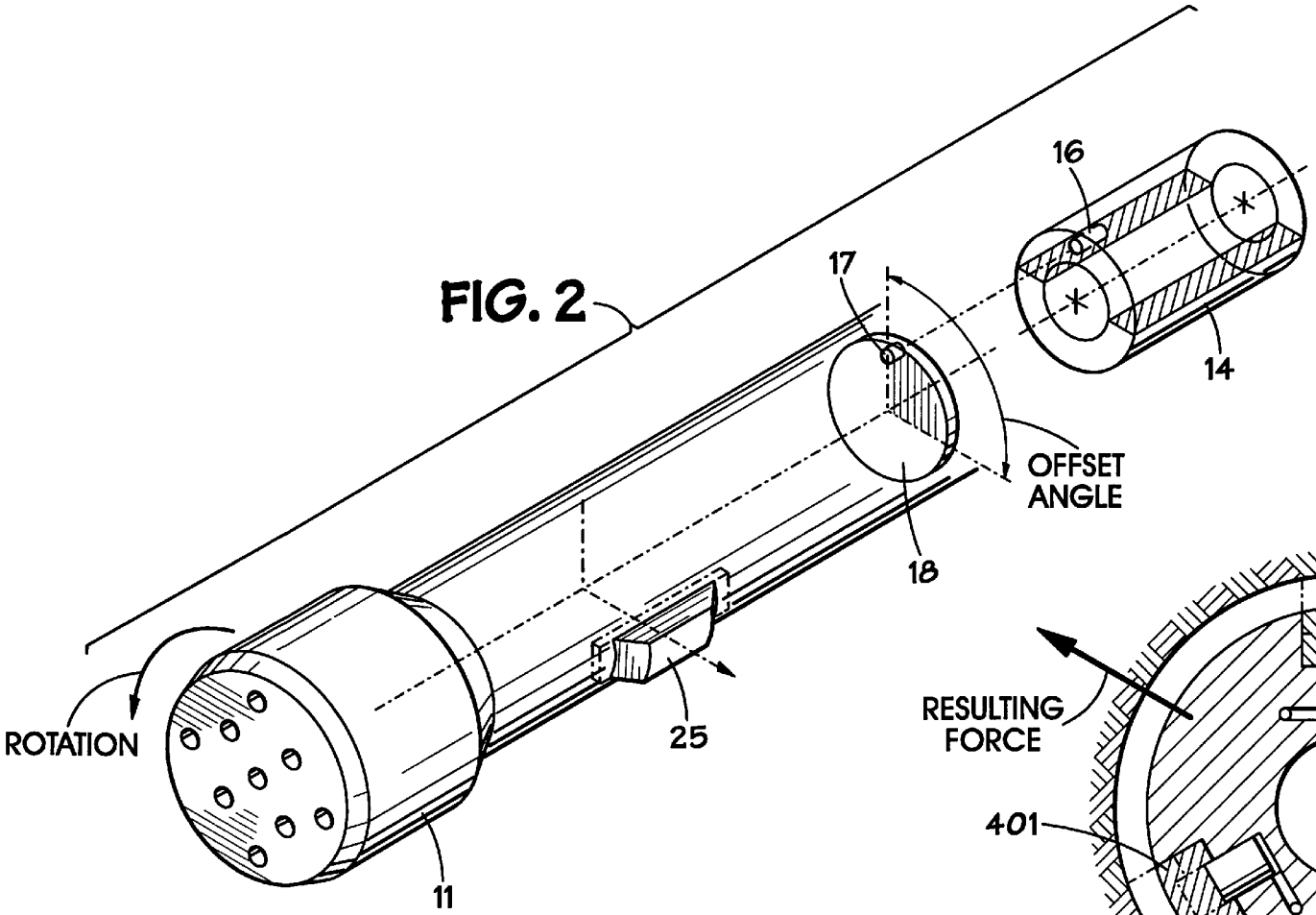
FIG. 2 is a mechanical schematic diagram which illustrates the relationship between components of a rotary steerable system in accordance with the present invention.

With reference to both FIGS. 1 and 2, the rotary steerable system of the present invention further comprises magnetic switch 17 which is installed in cartridge 13 on a carrier disk 18. In operation, carrier disk 18 will rotate as the drill string 9 rotates. The axis of magnetic switch 17 will thus coincide with the axis of permanent magnet 16 once during each revolution of drill string 9. Upon that coincidence, the magnetic switch 17 will be activated, since it will be switched to its "on" position. Once the magnetic switch 17 has rotated past the permanent magnet 16, the magnetic switch will be deactivated (i.e., it will turn "off") until the next revolution of the drill string.

A rotary steerable system in accordance with the present invention includes circuitry which is operatively connected to the magnetic switch 17 and which responds to the activation of the magnetic switch to trigger actuation of the pad 25. In the embodiment of FIG. 1, this circuitry is contained in electronics unit 20 and functions to connect battery 22 to the coil of solenoid 23. Master piston 24 is coupled to the core of solenoid 23 as shown in FIG. 1, and when magnetic switch 17 is "on," the circuitry in electronics unit 20 enables current to flow from battery 22 to energize the coil of solenoid 22. This energization causes the core of the solenoid 23 to translate (i.e., move), which results in the master piston 24 activating the hydraulic fluid associated with thrust pistons 26. Pad 25 is thus actuated at this time, and the wall of the borehole is "kicked."

In a particular drilling operation, it may be desirable to actuate the pad once every n rotations of the drill string 9, instead of actuating the pad on each rotation of the drill string. With reference to both FIGS. 1 and 3, the electronics unit 20 may contain circuitry 310 which is programmed before drilling operations begin with how often the pad 25 is to be actuated. Circuitry 310 may, for example, include a counter which is programmed with how many revolutions of drill string 9 are to occur before actuation of the pad occurs and which counts the "on" states of magnetic switch 17. This circuitry enables the energization of the coil of solenoid 23 by battery 22 when the programmed number of rotations of the drill string have occurred. For example, if actuation of the pad 25 is desired on each third rotation of the drill string 9, circuitry 310 would be programmed with that information and the pad would be actuated upon the occurrence of each third "on" state of magnetic switch 17. Alternatively, if magnet 16 is an electromagnet, circuitry 310 may be programmed to energize the electromagnetic once every n revolutions of the drill string.

In FIG. 2, a 90° separation exists between magnetic switch 17 and pad 25. In other words, the magnetic switch 17 in FIG. 2 is in the 12:00 o'clock position when it is switched to the "on" position, and pad 25 is thus in the 3:00 o'clock position when it is actuated. It may, however, be desirable in certain drilling operations to vary when pad 25 is actuated in the rotation of the drill string 9. To this end, the embodiment of the present invention illustrated in FIG. 1 includes electric motor 19, whose output shaft is coupled to carrier 18. When motor 19 is actuated (as described below), the output shaft of motor 19 rotates the carrier 18 independently of the rotation of the drill string 9 to vary the angular orientation of magnetic switch 17 with respect to pad 25. For example, if a 120° angular separation between magnetic switch 17 and pad 25 is desired (instead of the 90° separation shown in FIG. 2), the motor 19 would be actuated to move carrier 18 to the desired 120° separation. In this circumstance, the magnetic switch 17 is switched "on" when it is in the 12:00 o'clock position in FIG. 2, and therefore pad 25 is actuated when it is in the 4:00 o'clock position.

Figure 3:
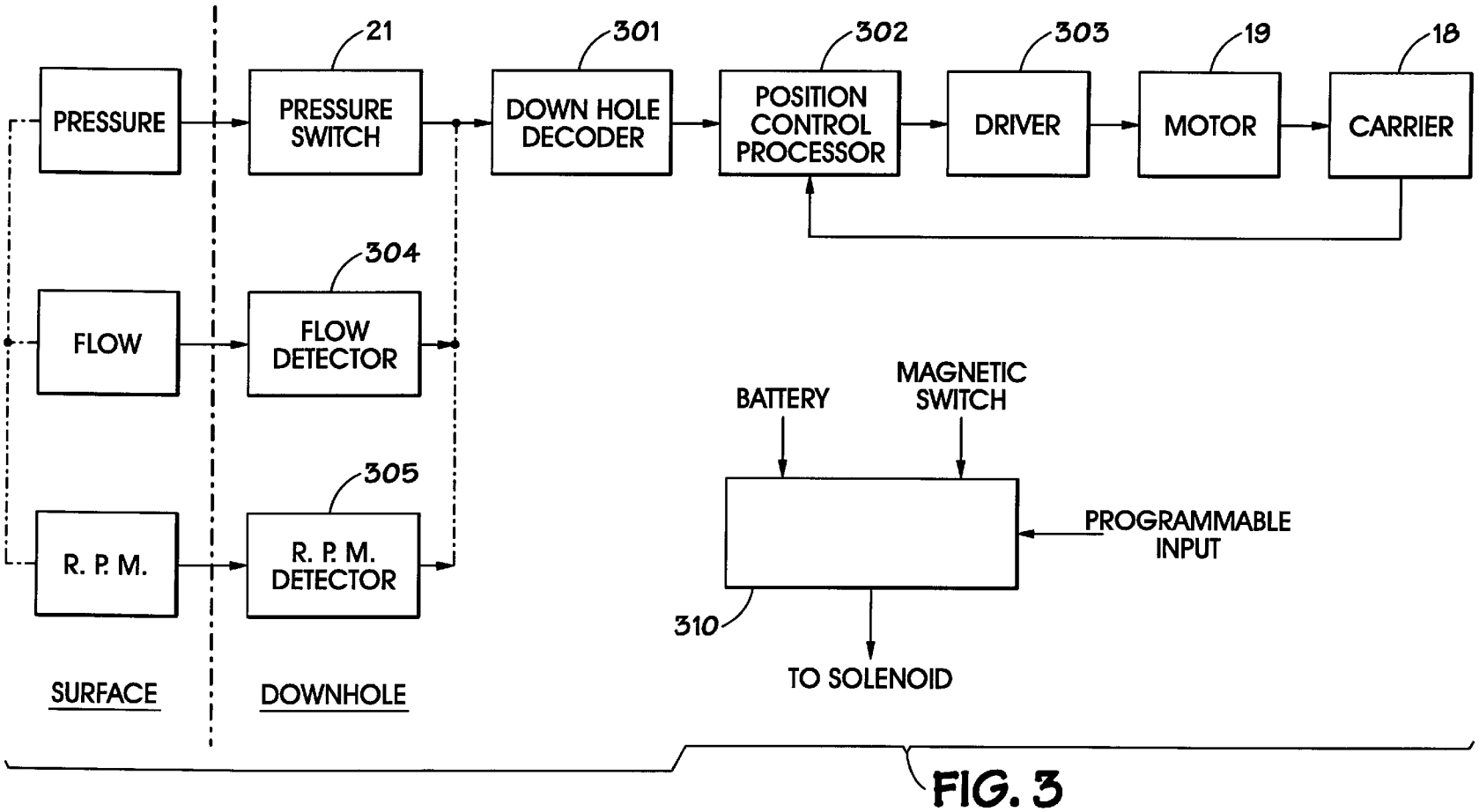
FIG. 3 is an electrical schematic in block diagram form of one implementation of electronics unit 20 of FIG. 1.

With reference to FIG. 3, electronics unit 20 contains circuitry to control the rotation of the carrier 18, and this circuitry. This circuitry includes a downhole decoder 301, a position control processor 302, a driver 303 and the motor 19. The downhole decoder 301 receives inputs from pressure switch 21, flow detector 304 and RPM detector 305. Pressure switch 21 is mounted in housing 8 proximate the central bore of the drill string and detects the pressure in the bottom hole assembly. Flow detector 304 functions to detect the rate of flow of drilling fluid in the bore of drill string 9 and may, for example, comprise a flow meter. RPM detector 305 functions to detect the rate at which the drill string 9 is rotating and may, for example, be an accelerometer, magnetometer or Hall effect switch. Flow detector 304 and RPM detector 305 are housed in electronics unit 20.

When the surface operator desires to change where in the rotation of the drilling string that the pad with the "kicked," the operator may remotely communicate from the surface with the electronics unit 20 by creating pressure, flow or rotation conditions that are different from those conditions that are used in normal drilling operations. For example, the bottom hole pressure may be increased above the normal drilling pressure by cycling the mud pumps. The speed of rotation of the drill string may be increased over normal drilling speeds. Also, the rate of flow of drilling fluid may be increased to a rate greater than normal flow rates.

With reference to FIGS. 1 and 3, downhole decoder 301, which is preferably a micropressor, continuously scans the outputs of pressure switch 21, flow detector 304 and RPM detector 305 and recognizes when a change in status of the pressure, flow or rotation speed parameter has occurred. Downhole decoder 301 is programmed to determine when a change in angular orientation of the magnetic switch 17 will be permitted. For example, the programming of downhole decoder 301 may be such that a change in the angular position of magnetic switch 17 will be permitted if a change in any of the pressure, flow or rotational speed parameters is recognized. Alternatively, the programming of downhole decoder may require a change in status of two of the parameters or a change in status of all three of the parameters before downhole decoder 301 before a change in the angular position of magnetic switch 17 will be permitted.

When downhole detector 301 recognizes that the proper conditions exist for a change in the angular position of magnetic switch 17, downhole detector 301 activates position control processor 302 (which is also preferably microprocessor). Position control processor 302 is programmed with the amount of change to be made in the angular position of magnetic switch 17, and signals representative of this amount of change are fed via driver 303 to motor 19, which moves carrier 18 the required angular amount. Motor 19 may be a step or linear motor.

Figure 4:
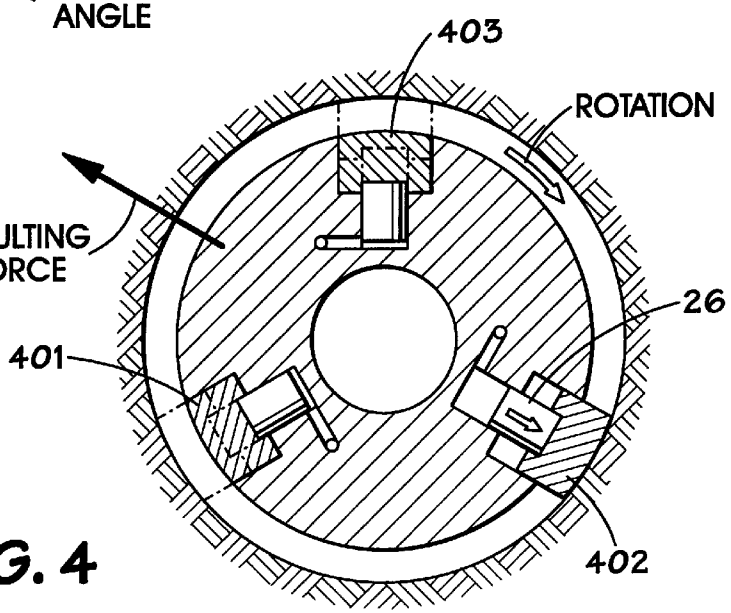
FIG. 4 is a cross-sectional view of a rotary steerable system illustrating the relationship between pads in the system.

Referring now to FIG. 4, an embodiment of a rotary steerable system in accordance with the present invention may include a plurality of pads 401, 402, and 403, which are installed on the periphery of the housing. The pads are preferably spaced at equal angular increments around the periphery. For example, with three pads as shown in FIG. 4, the angular spacing of the pads is 120°. In this embodiment of the invention, carrier 18 will contain three magnetic switches 17, one for each pad. As was the case with the embodiment using a single pad, the electronics unit 20 may be programmed such that each pad is not activated each time that its associated magnetic switch 17 is turned on.

What is claimed is:

1. A rotary steerable system for use in a rotating drill string for drilling a deviated well, the drill string including a drill bit and top sub, comprising:

a housing for receiving the rotary steerable system, which housing is connected in the drill string between the drill bit and the top sub for rotation with the drill string;

a pad which is installed on the periphery of the housing and which, when actuated, imparts a force to the wall of the borehole;

a cartridge in the housing which rotates with the housing;

a mechanical gravity reference device comprising (i) an unbalanced weight which is installed in the cartridge and which moves independently of the rotation of the drill string so that the heavy portion of the unbalanced weight is always oriented toward the low side of the borehole, and (ii) a magnet attached to a portion of the gravity reference device;

a magnetic switch whose angular position with respect to the pad is known, which switch is mounted in the cartridge proximate the gravity reference device for rotation with the drill string and which switch is activated when its axis coincides with the axis of the magnet; and circuitry operatively connected to the magnetic switch and responsive to the activation of the magnetic switch to trigger actuation of the pad.

2. The rotary steerable system of claim 1, further comprising a motor which is installed in the cartridge for changing the angular position of the magnetic switch with respect to the pad.

3. The rotary steerable system of claim 2, wherein the operation of the motor is controlled by a pressure switch.

4. The rotary steerable system of claim 2, wherein the magnetic switch is housed in a carrier and the motor rotates the carrier to change the angular position of the magnetic switch with respect to the pad.

5. The rotary steerable system of claim 1, wherein the circuitry energizes the coil of a solenoid in response to the activation of the magnetic switch to move the core of the solenoid to actuate hydraulic pistons associated with the pad.

6. A rotary steerable system for use in a rotary drill string for drilling a deviated well, the drill string including a drill bit and a top sub, comprising:

a housing for the rotary steerable system, which housing is connected in the drill string between the drill bit and the top sub for rotation with the drill string;

a plurality of pads which are installed on the periphery of the housing and which are equally spaced circumferentially from one another, each pad having an actuator, which when activated, causes the pad to impart a force to the wall of the borehole;

a cartridge in the housing which rotates with the housing;

a gravity reference device comprising (i) an unbalanced weight which is installed in the cartridge and which moves independently of the rotation of the drill string so that the heavy portion of the unbalanced weight is always oriented toward the low side of the borehole, and (ii) a permanent magnet attached to a portion of the gravity reference device;

a plurality of magnetic switches, one associated with each pad, where (i) the angular position of each magnetic switch with respect to its associated pad is known; (ii) each switch is mounted in the cartridge proximate the gravity reference device and (iii) each switch is activated when its axis coincides with the axis of the permanent magnet; and circuitry operatively connected to each magnetic switch and responsive to the activation of each switch to trigger actuation of the pad associated with the switch.

7. The rotary steerable system of claim 6, further comprising an electric motor which is installed in the cartridge for changing the angular position of the magnetic switch with respect to the pads.

8. The rotary steerable system of claim 7, wherein the operation of the electric motor is controlled by a pressure switch located in the bore of the housing.

9. The rotary steerable system of claim 7, wherein the magnetic switch is housed in a carrier and the motor rotates the carrier to change the angular position of the magnetic switch with respect to the pad.

10. The rotary steerable system of claim 6, wherein the circuitry energizes the coil of a solenoid in response to the activation of the magnetic switch to move the core of the solenoid to actuate hydraulic pistons associated with the pads.

11. In a drill string comprising a drill bit and a top sub for use in drilling a deviated well, a rotary steerable system comprising:

a housing for the rotary steerable system, which housing is connected in the drill string between the drill bit and the top sub for rotation with the drill string;

at least one pad which is installed on the periphery of the housing, each pad having an actuator, which when activated, causes the pad to impart a force to the wall of the borehole;

a cartridge in the housing which rotates with the housing;

a gravity reference device comprising (i) an unbalanced weight which is installed in the cartridge and which moves independently of the rotation of the drill string so that the heavy portion of the unbalanced weight is always oriented toward the low side of the borehole, and (ii) a permanent magnet attached to a portion of the gravity reference device;

a magnetic switch associated with each pad, where (i) the angular position of each magnetic switch with respect to its associated pad is known; (ii) each switch is mounted in the cartridge proximate the gravity reference device and (iii) each switch is activated when its axis coincides with the axis of the magnet; and circuitry operatively connected to each magnetic switch and responsive to the activation of each switch to trigger actuation of the pad associated with the switch.

* * * * *